US008661570B2

(12) United States Patent
Huh

(10) Patent No.: US 8,661,570 B2
(45) Date of Patent: Mar. 4, 2014

(54) AIR CUSHION FOR ATTACHING HEADBAND OF WELDING MASK

(71) Applicant: Otos Wing Co., Ltd., Seoul (KR)

(72) Inventor: Moon Young Huh, Seoul (KR)

(73) Assignee: Otos Wing Co., Ltd. (KR)

( * ) Notice: Subject to any disclaimer, the term of this patent is extended or adjusted under 35 U.S.C. 154(b) by 0 days.

(21) Appl. No.: 13/653,736

(22) Filed: Oct. 17, 2012

(65) Prior Publication Data

US 2013/0111653 A1 May 9, 2013

(30) Foreign Application Priority Data

Nov. 4, 2011 (KR) ..... 10-2011-0114259

(51) Int. Cl.
*A42B 3/12* (2006.01)

(52) U.S. Cl.
USPC ..... 2/418; 2/421

(58) Field of Classification Search
USPC ..... 2/410, 411, 413, 414, 417, 418, 421, 2/416, DIG. 3, DIG. 11, 181, 183
See application file for complete search history.

(56) References Cited

U.S. PATENT DOCUMENTS 562,817 A * 6/1896 Frick ..... 2/181.8
591,289 A * 10/1897 McMeekin ..... 54/38.1
1,391,753 A * 9/1921 Baier ..... 2/413
1,510,482 A * 10/1924 Kramer ..... 2/183
2,759,186 A * 8/1956 Dye ..... 2/413
3,047,879 A * 8/1962 Spreiregen ..... 2/181
3,488,774 A * 1/1970 Abbott ..... 2/68
3,668,704 A * 6/1972 Conroy et al. ..... 2/413
3,713,640 A * 1/1973 Margan ..... 267/117
3,787,893 A * 1/1974 Larcher ..... 2/413
3,866,243 A * 2/1975 Morgan ..... 2/418
3,872,511 A * 3/1975 Nichols ..... 2/413
4,333,179 A * 6/1982 Laurita ..... 2/468
4,484,364 A * 11/1984 Mitchell et al. ..... 2/413
4,941,210 A * 7/1990 Konucik ..... 2/171
5,031,246 A * 7/1991 Kronenberger ..... 2/195.2
5,129,106 A * 7/1992 Liou ..... 2/411
5,263,203 A * 11/1993 Kraemer et al. ..... 2/413
5,315,715 A * 5/1994 Kronenberger ..... 2/183
5,325,539 A * 7/1994 Kronenberger ..... 2/195.2
5,337,420 A * 8/1994 Haysom et al. ..... 2/410
5,375,264 A * 12/1994 Arena ..... 2/195.2
5,551,094 A * 9/1996 Navone ..... 2/421

(Continued)

FOREIGN PATENT DOCUMENTS

GB 2209459 A * 5/1989

*Primary Examiner* — Danny Worrell
(74) *Attorney, Agent, or Firm* — Cantor Colburn LLP

(57) ABSTRACT

Disclosed is a headband with an air cushion pad, which is mounted on a welding mask, a working helmet, a safety mask or a protective mask. A plurality of air pockets is arranged at regular intervals or asymmetrical intervals within the air cushion pad mounted on the entirety or a part of the headband contacting the worker's head, a plurality of projections is formed on the front surface of the air cushion pad contacting the worker's head, the worker's forehead or the rear portion of the worker's head, and if the worker wears the headband, the amount of air filling air pockets is adjusted according to a shape of the worker's head or a pressing degree of the headband onto the worker's head so that the worker may firmly and comfortably wear the headband under the condition that the headband is completely adhered to the worker's head.

7 Claims, 12 Drawing Sheets

(56) References Cited

U.S. PATENT DOCUMENTS

| | | | | |
|---|---|---|---|---|
| 6,526,586 | B2 * | 3/2003 | Gattamorta | 2/12 |
| 6,560,789 | B2 * | 5/2003 | Whalen et al. | 2/455 |
| 6,591,429 | B1 * | 7/2003 | Jaszai | 2/455 |
| 6,817,039 | B1 * | 11/2004 | Grilliot et al. | 2/413 |
| 7,827,624 | B1 * | 11/2010 | Cole | 2/458 |
| 7,882,844 | B2 * | 2/2011 | Chininis et al. | 132/279 |
| 8,105,129 | B2 * | 1/2012 | Chen | 450/38 |
| 2004/0226078 | A1 * | 11/2004 | Lahman et al. | 2/413 |
| 2010/0251451 | A1 * | 10/2010 | Feldman et al. | 2/2.5 |

* cited by examiner

AIR CUSHION FOR ATTACHING HEADBAND OF WELDING MASK

BACKGROUND OF THE INVENTION

1. Field of the Invention

The present invention relates to a headband with an air cushion pad, and more particularly to a headband with an air cushion pad which is used on welding masks, working helmets, safety masks, protective masks or medical devices, contacts a worker's forehead or the outer circumferential surface of a worker's head, or the rear portion or the upper portion of the worker's head, and adjusts an amount of air filling air pockets according to a pressing degree of the air cushion pad onto the worker's head due to a shape of the worker's head so as to be firmly mounted on the worker's head and to be comfortably worn by the worker.

2. Description of the Related Art

A headband is integrally fixed to the inside of one selected from welding masks, protective masks, safety helmets and medical devices so as to be stably worn by a worker. For example, a headband on a welding mask includes a holding piece surrounding the outer circumferential surface of a worker's head and having an adjustable diameter and a supporting piece located at the upper portion of the worker's head, and the holding piece and the supporting piece are configured such that the lengths thereof may be freely adjustable.

In such a conventional headband used in the welding mask, a sponge sheet absorbing sweat rolling down to the worker's face during work and providing comfortable wear feeling is integrally provided in front of the holding piece.

However, the headband used in the welding mask may be disadvantageous in that when the headband is frequently used, cushion force of the sponge sheet provided in front of the holding piece and contacting the worker's head is lowered, and if the worker wears the headband, the worker may not firmly and comfortably wear the headband under the condition that the headband is completely adhered to the worker's head, according to a head shape difference between workers or a pressing degree difference of the headband to workers.

SUMMARY OF THE INVENTION

Therefore, the present invention has been made in view of the above problems, and it is an object of the present invention to provide a headband with an air cushion pad which adjusts an amount of air according to a shape of a worker's forehead or a pressing degree of the headband onto the worker's forehead, and is firmly and comfortably worn by the worker under the condition that the headband is completely adhered to the worker's forehead.

It is another object of the present invention to provide a headband with an air cushion pad which is firm enough to support a heavy welding mask on a wearer's head, and reduces pain and inconvenience of a wearer caused by pressing onto the wearer's head if work is carried out for a long time and leaning of the welding mask due to off-axis due to the weight of the welding mask.

In accordance with the present invention, the above and other objects can be accomplished by the provision of a headband with an air cushion pad mounted on a front part of the headband mounted on a welding mask, etc. contacting a worker's head or the entirety of the headband, wherein a plurality of air pockets is arranged at regular intervals or asymmetrical intervals within the air cushion pad, an upper fixing wing is connected to the upper end of the air cushion pad, and a lower fixing wing is connected to the lower end of the air cushion pad.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
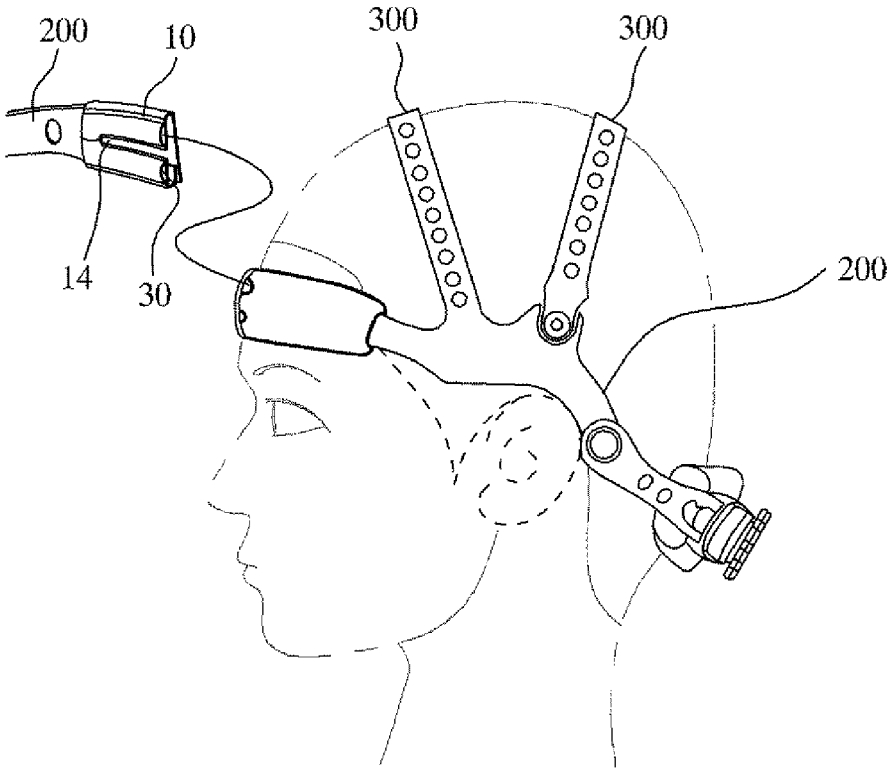
FIG. 1 is a view illustrating a state in which an air cushion pad in accordance with one embodiment of the present invention is placed on a wearer's forehead.

Now, preferred embodiments in accordance with the present invention will be described in detail with reference to the annexed drawings.

Hereinafter, a headband with an air cushion pad in accordance with each of the embodiments of the present invention will be described with reference to the accompanying drawings.

A headband 200 in accordance with the present invention includes an air cushion pad 10 which is mounted at the front portion of the headband 200 placed on a welding mask or a protective mask contacting a worker's head or is mounted on the entirety of the headband 200. A plurality of air pockets 30 is arranged at regular intervals or asymmetrical intervals within the air cushion pad 10, an upper fixing wing 20 is connected to the upper end of the air cushion pad 10, and a lower fixing wing 22 is connected to the lower end of the air cushion pad 10.

In the headband 200 in accordance with the present invention, the surface of the air cushion pad 10 may include a plurality of projections and through holes or have a plurality of embossings. Further, in the headband 200 in accordance with the present invention, an air pump 40 may be mounted on the air cushion pad 10.

With reference to FIG. 1, the air cushion pad 10 is mounted at the front portion of the headband 200 in accordance with the present invention contacting the worker's head, and a plurality of air pockets 30 is arranged at regular intervals or asymmetrical intervals within the air cushion pad 10.

Figure 2:
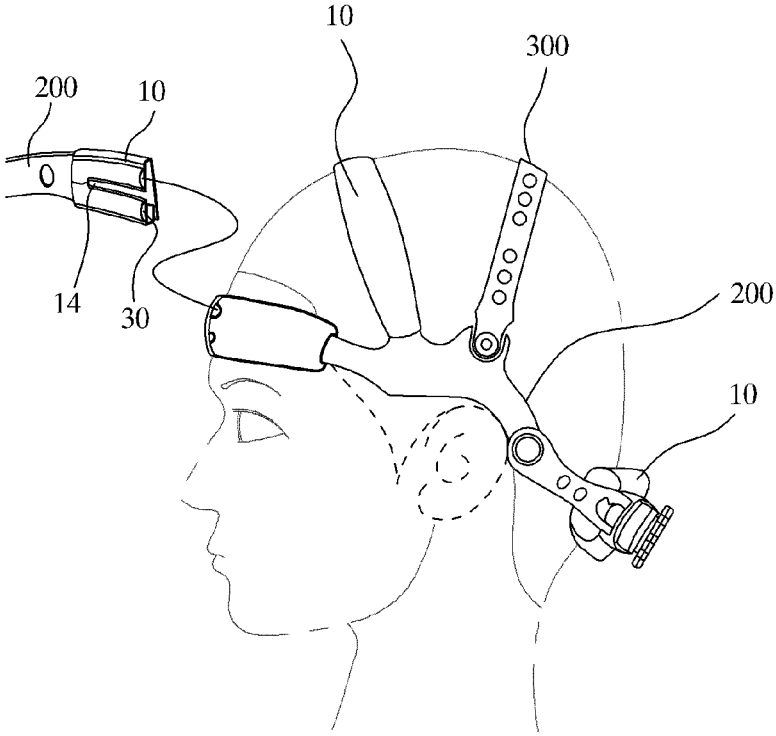
FIG. 2 is a view illustrating a state in which the air cushion pad in accordance with the embodiment of the present invention is placed on the upper portion of a wearer's head.
Figure 3:
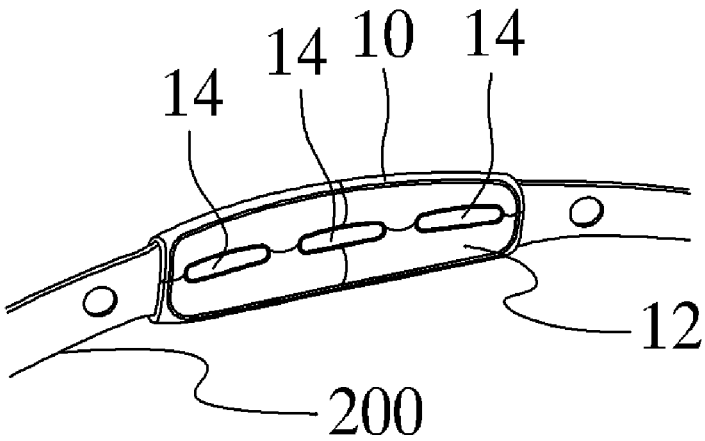
FIG. 3 is a perspective view of an air cushion pad in accordance with one embodiment of the present invention.
Figure 4:
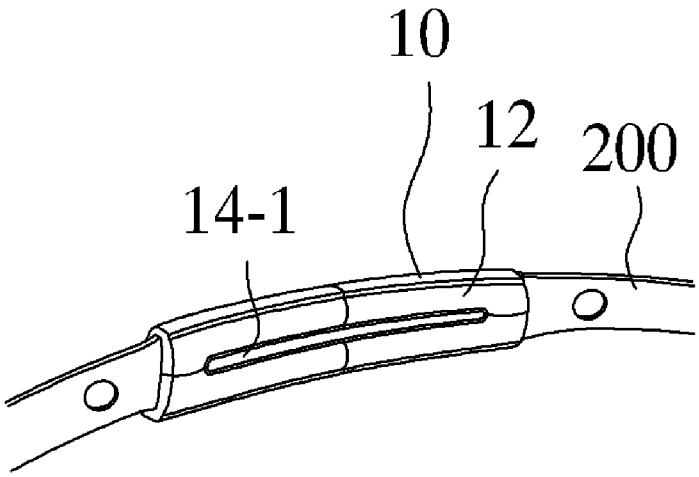
FIG. 4 is a perspective view of an air cushion pad in accordance with another embodiment of the present invention.
Figure 5:
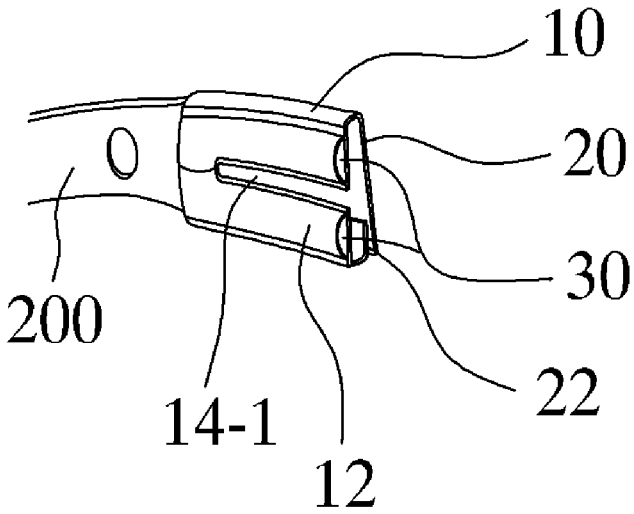
FIG. 5 is a cross-sectional view of the air cushion pad in accordance with the embodiment of the present invention.
Figure 6:
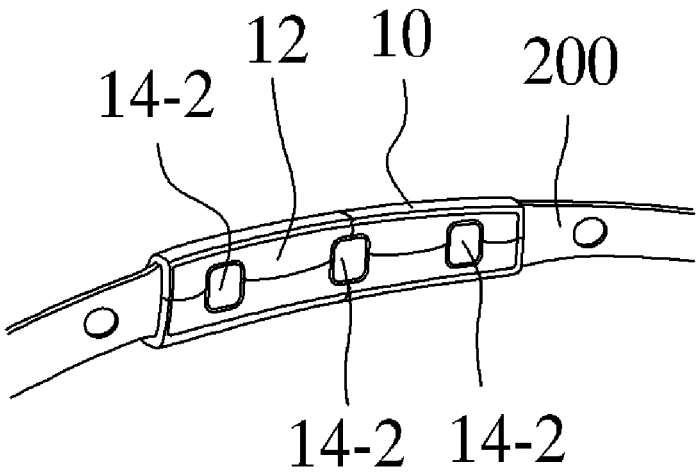
FIG. 6 is a perspective view of an air cushion pad in accordance with another embodiment of the present invention.
Figure 7:
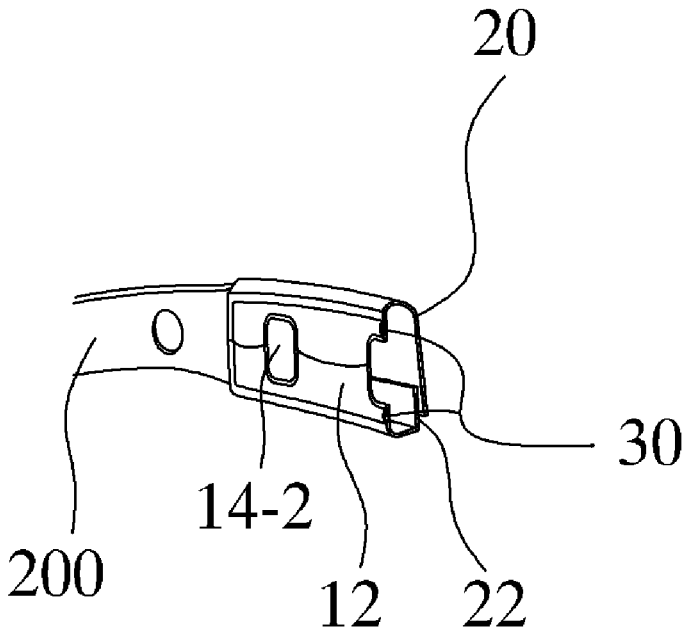
FIG. 7 is a cross-sectional view of the air cushion pad in accordance with the embodiment of the present invention.
Figure 8:
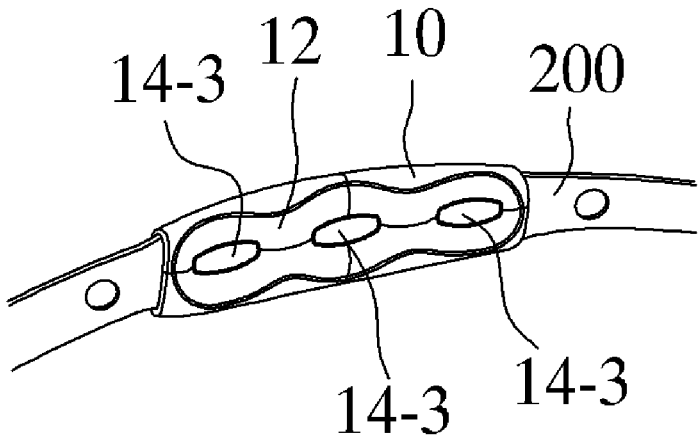
FIG. 8 is a perspective view of an air cushion pad in accordance with another embodiment of the present invention.
Figure 9:
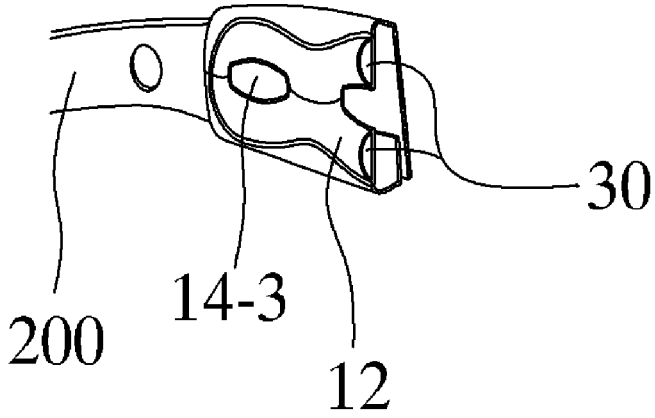
FIG. 9 is a cross-sectional view of the air cushion pad in accordance with the embodiment of the present invention.
Figure 10:
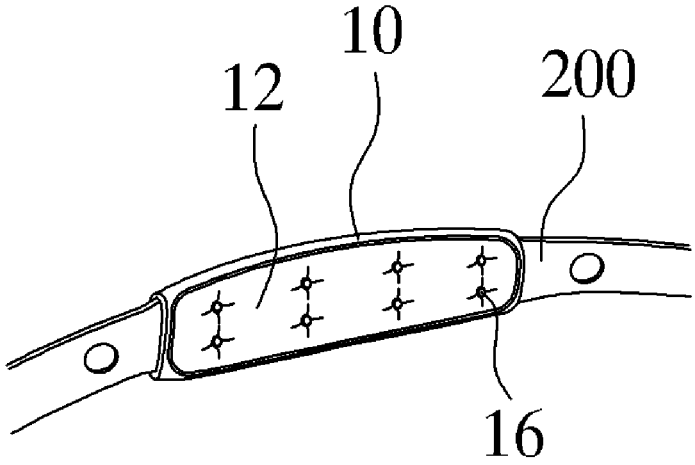
FIG. 10 is a perspective view of an air cushion pad in accordance with another embodiment of the present invention.
Figure 11:
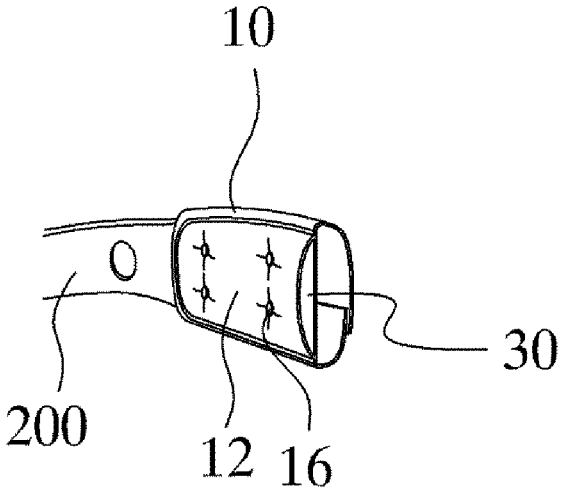
FIG. 11 is a cross-sectional view of the air cushion pad in accordance with the embodiment of the present invention.
Figure 12:
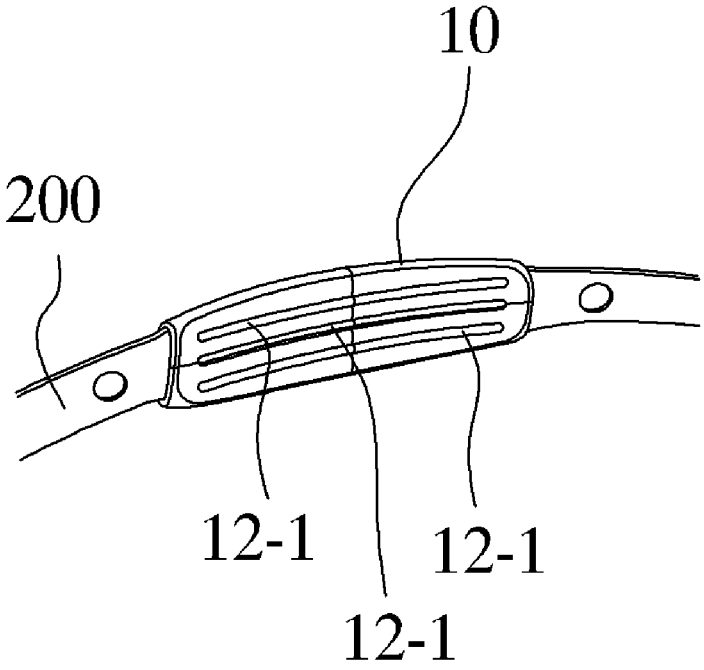
FIG. 12 is a perspective view of an air cushion pad in accordance with another embodiment of the present invention.
Figure 13:
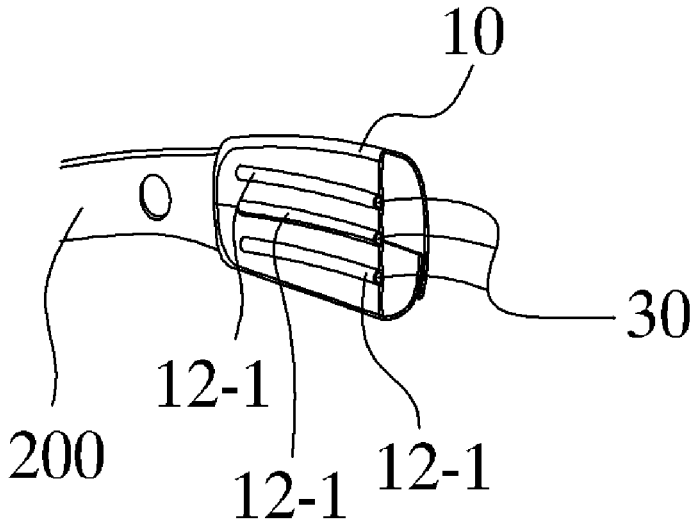
FIG. 13 is a cross-sectional view of the air cushion pad in accordance with the embodiment of the present invention.
Figure 14:
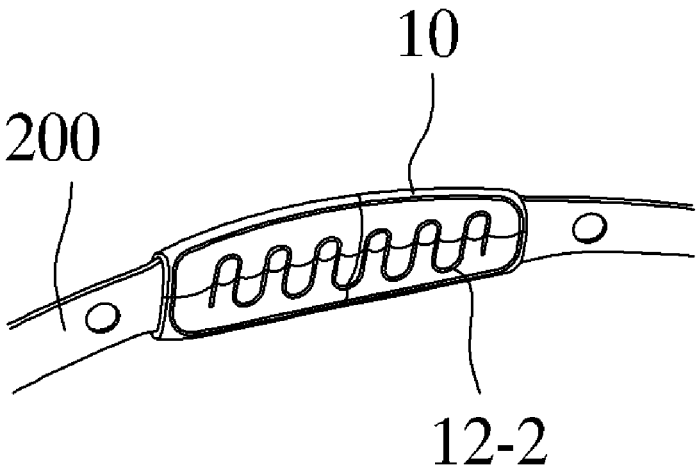
FIG. 14 is a perspective view of an air cushion pad in accordance with another embodiment of the present invention.
Figure 15:
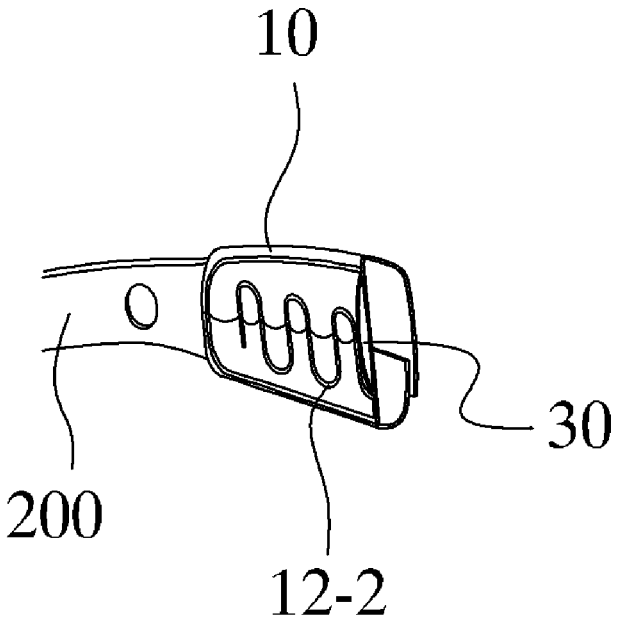
FIG. 15 is a cross-sectional view of the air cushion pad in accordance with the embodiment of the present invention.
Figure 16:
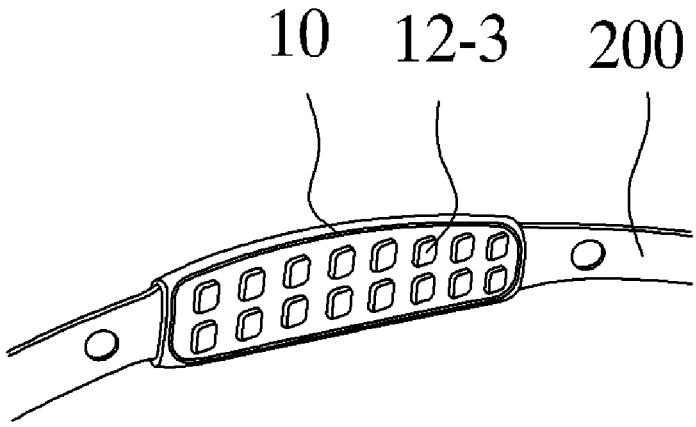
FIG. 16 is a perspective view of an air cushion pad in accordance with another embodiment of the present invention.
Figure 17:
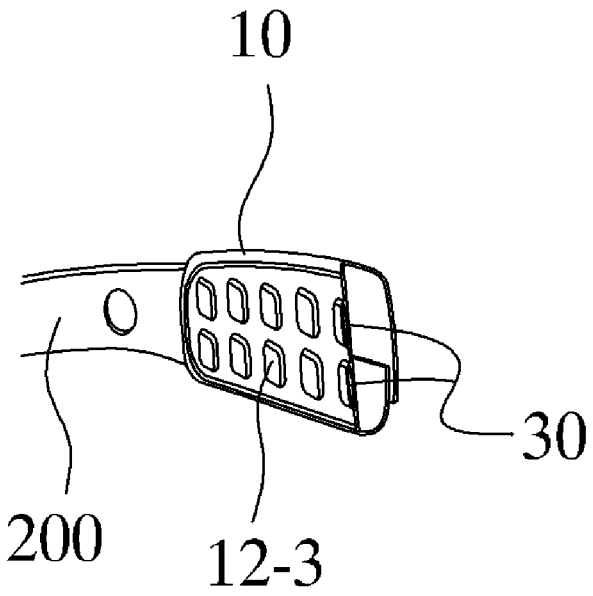
FIG. 17 is a cross-sectional view of the air cushion pad in accordance with the embodiment of the present invention.
Figure 18:
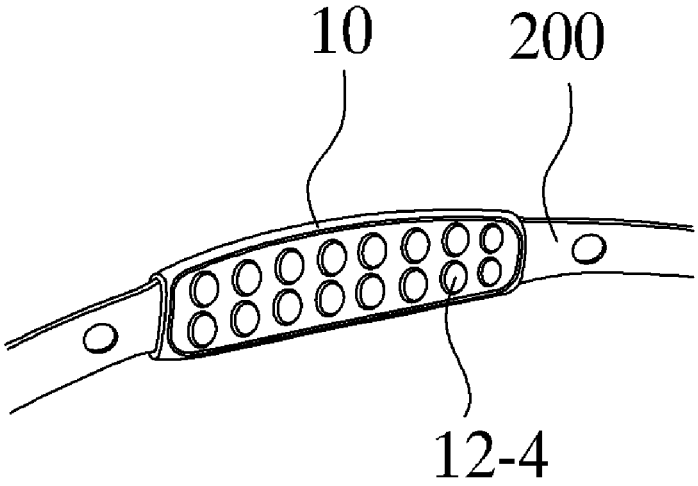
FIG. 18 is a perspective view of an air cushion pad in accordance with another embodiment of the present invention.
Figure 19:
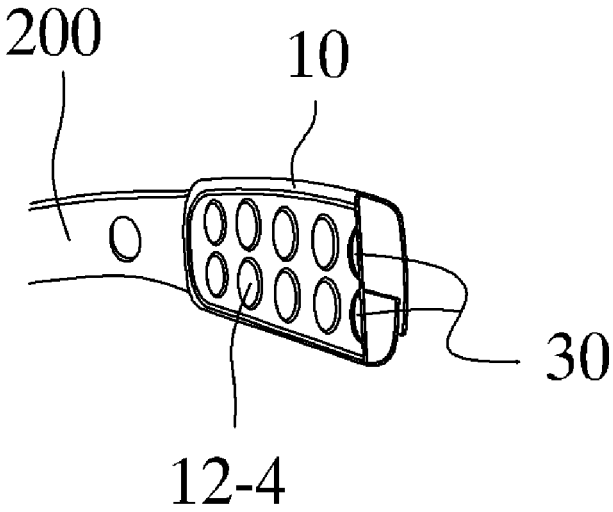
FIG. 19 is a cross-sectional view of the air cushion pad in accordance with the embodiment of the present invention.
Figure 20:
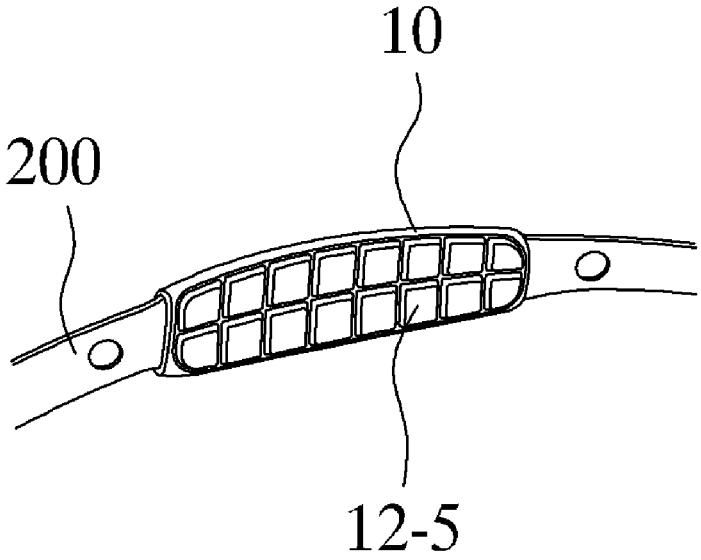
FIG. 20 is a perspective view of an air cushion pad in accordance with another embodiment of the present invention.

With reference to FIG. 2, the air cushion pad 10 is mounted on the entirety or a part of the headband 200 contacting the worker's head.

As shown in FIGS. 1 to 22, the headband 200 in accordance with the present invention, the upper fixing wing 20 is connected to the upper end of the air cushion pad 10, and the lower fixing wing 22 is connected to the lower end of the air cushion pad 10, thereby causing the air cushion pad 10 to be easily mounted at the front portion of the headband 200.

As shown in FIGS. 1 to 22, if a worker wears the headband 200 in accordance with the present invention, the amount of air filling the air pockets 30 is adjusted according to a shape of the worker's head or a pressing degree of the headband 200 onto the worker's head, and thus the worker may conveniently use the headband 200.

In the headband 200 in accordance with the present invention, the air pockets 30 may be arranged at regular intervals or asymmetrical intervals within the air cushion pad 10 so that the worker may firmly and conveniently wear the headband 200 under the condition that the protrusions 12 formed on the front surface of the air cushion pad 10 contacting the worker's head are completely adhered to the worker's head.

As shown in FIGS. 2 to 9, the headband 200 in accordance with the present invention may include a plurality of projections 12, 12-1, 12-2, 12-3, 12-4 or 12-5 formed on the front surface of the air cushion pad 10 contacting the worker's head or the worker's forehead, and a plurality of through holes 14, 14-1, 14-2 or 14-3 formed between the projections 12, 12-1, 12-2, 12-3, 12-4 or 12-5.

As described above, the projections 12, 12-1, 12-2, 12-3, 12-4 or 12-5 of the headband 200 in accordance with the present invention may be manufactured in various shapes, and may be manufactured in various tube types in which the through holes 14, 14-1, 14-2 or 14-3 are formed between the projections 12, 12-1, 12-2, 12-3, 12-4 or 12-5.

As shown in FIGS. 10 to 20, the headband 200 in accordance with the present invention may include a plurality of projections 12, 12-1, 12-2, 12-3, 12-4 or 12-5 formed on the front surface of the air cushion pad 10 contacting the worker's head, and a plurality of embossings 16 formed between the projections 12, 12-1, 12-2, 12-3, 12-4 or 12-5. The projections 12, 12-1, 12-2, 12-3, 12-4 or 12-5 of the headband 200 in accordance with the present invention may be manufactured in various shapes and the embossings 16 formed between the projections 12, 12-1, 12-2, 12-3, 12-4 or 12-5 may be manufactured in various shapes so as to prevent the headband 200 from slipping on the worker's head.

Figure 21:
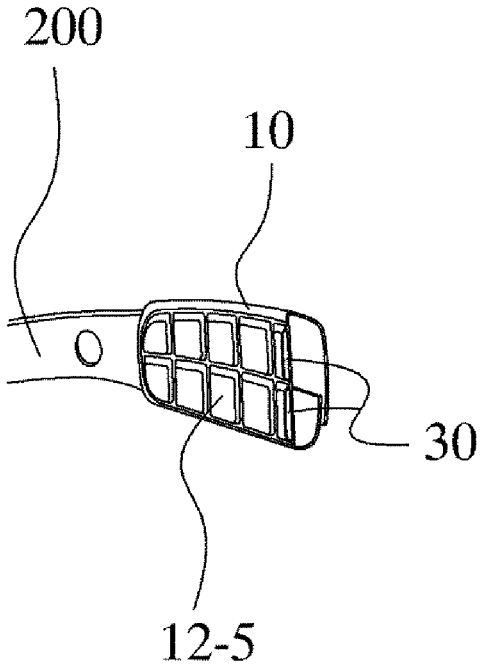
FIG. 21 is a cross-sectional view of the air cushion pad in accordance with the embodiment of the present invention.
Figure 22:
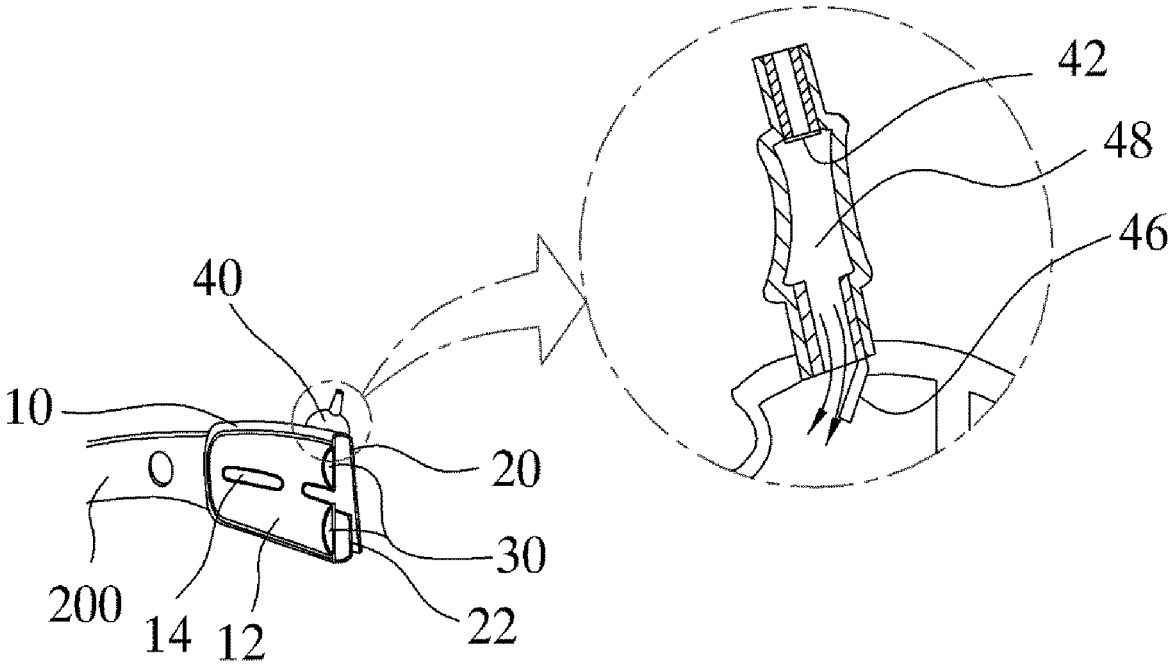
FIG. 22 is a cross-sectional view of an air cushion pad on which an air pump is installed in accordance with a further embodiment of the present invention.

As shown in FIGS. 21 and 22, in the headband 200 in accordance with the present invention, an air pump 40 may be mounted on the air cushion pad 10, and, if an air bag 48 of the air pump 40 is filled with air, when a worker compresses the air bag 48 under the condition that the worker wears the headband 200, a first check valve 42 is closed and a second check valve 46 is opened, and thus air within the air bag 48 is sucked into the air pockets 30 of the air cushion pad 10 to expand the air pockets 30, and when the air pockets 30 are expanded, the projections 12 formed on the front surface of the air cushion pad 10 contacting the worker's forehead are completely adhered to the worker's forehead and thus the worker may firmly and comfortably wear the headband 200.

In case of the headband 200 in accordance with the present invention, air within the air cushion pad 10 freely moves and transfers according to a shape of a mask or helmet wearer's head, a wearing method of a mask or helmet and a structure of a functional product, and thus comfortableness and close adhesion are maximized.

In accordance with a further embodiment of the present invention, the air cushion pad 10 is mounted on the entirety or a part of the headband 200 contacting the worker's head, and is further mounted on an upper fixing band 300. Thereby, air within the air pockets 12 freely moves and transfers according to a shape of a mask or helmet wearer's head, a wearing method of a mask or helmet and a structure of a functional product, and thus comfortableness and close adhesion are maximized.

As apparent from the above description, the present invention provides a headband with an air cushion pad which minimizes weight feeling and pressure applied to a worker's head generated by wearing a welding helmet or a welding mask for a long time.

Further, the headband in accordance with the present invention adjusts the amount of air filling air pockets of the air cushion pad according to a shape of the worker's head or a pressing degree of the headband onto the worker's head, and thus the worker may firmly and comfortably wear the headband under the condition that the headband is completely adhered to the worker's head.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A headband with an air cushion pad, which is mounted on a welding mask, a working helmet, a safety mask, a protective mask or a medical device and which a worker wears on his/her head, wherein the air cushion pad is mounted on a front part of the headband contacting the worker's forehead, the entirety of the headband contacting the worker's forehead and the rear portion of the worker's head, or another part of the headband, and a plurality of air pockets is arranged at regular intervals or asymmetrical intervals within the air cushion pad, wherein an amount of air filling the air pockets is adjusted according to a shape of the worker's head, wherein an air pump is provided on a side surface of the air cushion pad so as to allow the worker to directly pump air by hand, wherein the air pump includes an air bag, a first check valve, and a second check valve, wherein the first check valve is configured to close and the second check valve is configured to open based on compression of the air bag while the worker is wearing the headband in order for air within the air bag is sucked into the air pockets.

2. The headband of claim 1, wherein the air cushion pad includes a plurality of projections on the surface thereof, wherein the plurality of projections are arranged to form a plurality of columns and a plurality of rows.

3. The headband of claim 1, wherein the air cushion pad includes a plurality of projections on the surface thereof, wherein the air cushion pad is a tube provided with a plurality of through holes formed between the projections.

4. The headband of claim 1, wherein an upper fixing wing and a lower fixing wing are detachably adhered to each other.

5. The headband of claim 1, wherein the amount of air filling the air pockets is adjusted according to a pressing degree of the headband onto the worker's head.

6. The headband of claim 1, wherein the air cushion pad includes a plurality of projections on the surface thereof, wherein the air cushion pad further includes a plurality of embossings formed between the projections.

7. The headband of claim 1, wherein the air pockets are configured in a manner that allows air in the air pockets to move and transfer freely according to a shape of the worker's head.

* * * * *